US006007584A

United States Patent [19]

Suzuki et al.

[11] Patent Number: 6,007,584

[45] Date of Patent: Dec. 28, 1999

[54] SCOURING AGENT COMPOSITION FOR FIBER

[75] Inventors: Nobuyuki Suzuki; Takashi Okuno; Shuichi Inaya, all of Wakayama, Japan

[73] Assignee: Kao Corporation, Tokyo, Japan

[21] Appl. No.: 09/145,329

[22] Filed: Sep. 1, 1998

[30] Foreign Application Priority Data

Sep. 1, 1997 [JP] Japan ..... 9-235827
Mar. 18, 1998 [JP] Japan ..... 10-068242

[51] Int. Cl.[6] ..... D06L 1/00

[52] U.S. Cl. ..... 8/139; 8/137; 510/347; 510/351; 510/356; 510/357; 510/358

[58] Field of Search ..... 8/139, 137, 138; 510/347, 351, 356, 357, 358

[56] References Cited

U.S. PATENT DOCUMENTS 3,567,784 3/1971 Tsatsos et al. ..... 568/625

FOREIGN PATENT DOCUMENTS 6-93558 4/1994 Japan .

OTHER PUBLICATIONS

J. Ellis in Chemistry of the Textiles Industry, edited by C.M. Carr, pp. 249–250 and 259–260 (month unknown), 1995.
Patent abstract of Japanese application No. JP–87054840 B; Nov. 1987.
Patent abstract of Japanese application No. JP–88012192 B; Mar. 1988.
Patent abstract of Japanese application No. JP–2575236 B; Jan. 1997.
Patent abstract of Japanese application No. JP–47009561 A; 1972 (month unknown).
Patent abstract of Japanese application No. JP–08060532 A; Mar. 1966.

*Primary Examiner*—Alan Diamond
*Attorney, Agent, or Firm*—Birch, Stewart, Kolasch & Birch, LLP

[57] ABSTRACT

The present invention provides a method for souring, using an scouring agent composition which has low-viscosity although being highly concentrated, which has excellent scouring property under highly alkaline conditions, and which has excellent biodegradability. That is, the present invention provides a method for scouring fiber, which comprises the step of treating the fiber with a scouring agent comprising (A) a nonionic surfactant having the formula (I):

$$R_1—O—(EO)_l(PO)_m(EO)_nH \quad (I)$$

in which $R_1$ is an alkyl or an alkenyl, being straight or branched, having 8 to 22 carbon atoms, EO is an oxyethylene unit, PO is an oxypropylene unit, l and n are an average mole number of added oxyethylene units, m is an average mole number of added oxypropylene units, l is a number of 1 to 12, m is a number of 1 to 4 and n is a number of 1 to 12, provided that $(EO)_l$, $(PO)_m$ and $(EO)_n$ are blocks connected in this order.

10 Claims, No Drawings

SCOURING AGENT COMPOSITION FOR FIBER

DETAILED DESCRIPTION OF THE INVENTION

1. Technical Field to Which the Invention Belongs

The present invention relates to a scouring agent composition for fiber used in the step of removing various impurities for improving bleaching, dyeing, finishing and other processing effects in natural fibers, such as cotton, synthetic fibers, such as polyester, and fiber products of a blend of these fibers, and the like.

2. Prior Art

Resin, wax and the like in the case of natural fibers, for example, vegetable fibers, fat, colloidal materials and the like in the case of animal fibers, and a large amount of paraffin wax and acrylic ester, polyvinyl alcohol and other sizing agents and the like added in the step of spinning in the case of polyester-base new synthetic fiber fabrics are present as impurities, and unsatisfactory removal of these impurities in the step of scouring leads to emission of smoke in the step of drying and uneven bleaching, dyeing, and finishing.

In the step of scouring, a nonionic surfactant, an anionic surfactant, or a mixture of these surfactants has hitherto been mainly used as a scouring agent. Examples of the nonionic surfactant scouring agent include propylene oxide (hereinafter abbreviated to "PO") and ethylene oxide (hereinafter abbreviated to "EO") adducts of alkylphenols and higher alcohols. More specifically, JP-B 62-54840 and JP-A 47-9561 disclose EO-PO-EO triblock adducts of particular aromatic and aliphatic alcohols, JP-B 63-12192 discloses EO-PO block adducts of particular alcohols, and Japanese Patent Gazette No. 2575236 discloses PO-EO-PO triblock adducts of particular alcohols. All the above adducts aim to reduce foaming. JP-A 8-60532 discloses a scouring agent composition prepared by randomly adding EO and PO to a particular alcohol and combining the EO-added nonionic surfactant with an anionic surfactant in particular proportions. The claimed advantage of this technique is to offer high active component concentration or low viscosity at a low temperature.

Problems that the Invention is to Solve

The nonionic surfactants described in the JP-B 63-12192 and the Japanese Patent Gazette No.2575236 due to the presence of a PO chain at the end and the surfactants disclosed in the JP-A 47-9561 due to an excessive long PO chain have a poor scouring property under highly alkaline conditions. Further, in the scouring agent composition described in the JP-A 8-60532, although the active component concentration can be increased, even when the anionic surfactant is additionally used, the active component concentration is up to about 65% by weight. Further, this composition is still poor in the scouring property under highly alkaline conditions. Therefore, a further improvement in the scouring agent composition has been desired in the art.

Furthermore, from the viewpoint of biodegradability, it is difficult to use a scouring agent containing an aromatic alcohol and a scouring agent with the mole number of added PO units being large.

That is, a souring agent composition has not been developed which is a highly concentrated scouring agent composition, can have high active component concentration, and has low-temperature stability, excellent scouring property under highly alkaline conditions, and excellent biodegradability.

Means for Solving the Problems

The present inventors have found that a scouring agent composition containing a nonionic surfactant comprising an EO-PO-EO triblock adduct of a particular aliphatic alcohol has an excellent scouring property under highly alkaline conditions and excellent biodegradability and low-temperature stability, and can realize an active component concentration of as high as 60% by weight or above and, particularly when used in combination with an anionic surfactant or a glycol ether, an active component concentration of as high as 70% by weight or above, which has led to the completion of the present invention.

The present invention provides a method for scouring fiber, which comprises the step of treating the fiber with a scouring agent comprising (A) a nonionic surfactant having the formula (I):

$$R_1—O—(EO)_l(PO)_m(EO)_nH \quad (I)$$

in which $R_1$ is an alkyl or an alkenyl, being straight or branched, having 8 to 22 carbon atoms, EO is an oxyethylene unit, PO is an oxypropylene unit, l and n are an average mole number of added oxyethylene units, m is an average mole number of added oxypropylene units, l is a number of 1 to 12, m is a number of 1 to 4 and n is a number of 1 to 12, provided that $(EO)_l$, $(PO)_m$ and $(EO)_n$ are blocks connected in this order.

Secondly, the present invention provides the method according to the first one, in which the scouring agent further comprising (B) at least one compound selected from the group consisting of an anionic surfactant and a glycol ether.

Thirdly, the present invention provides the method according to the second one, in which the anionic surfactant is a phosphate derivative or a sulfate derivative of a polyoxyalkylene alkyl ether having the formula (II):

$$R_2—O—(AO)_p—H \quad (II)$$

in which $R_2$ is an alkyl, an alkenyl, an alkylaryl or an aralkyl, having 6 to 24 carbon atoms, AO is an oxyalkylene unit having 2 to 4 carbon atoms, p is an average mole number of added oxyalkylene units, ranging from 2 to 5.

Fourthly, the present invention provides the method according to the second one, in which the glycol ether has 3 to 10 carbon atoms.

Fifthly, the present invention provides the method according to the second one, in which a weight ratio of (A) to (B) ranges from 40/60 to 99/1.

Sixthly, the present invention provides the method according to the first or second one, in which the total amount of (A) and (B) in the scouring agent is to 70 to 97 percent by weight.

Seventhly, the present invention provides the method according to the second one, in which comprises as (B) both an anionic surfactant and a glycol ether at a weight ratio ranging from 9/1 to 1/9.

Eighthly, the present invention provides the method according to the second one, in which the anionic surfactant is selected from the group consisting of a polyoxyalkylene alkylsulfate, a polyoxyalkylene mono-phosphate, a polyoxyalkylene di-phosphate and a salt thereof with a basic inorganic compound or a basic organic compound.

Mode for Carrying Out the Invention

The component (A) of the present invention is a polyoxyalkylene type nonionic surfactant represented by the formula (I), and examples of $R_1$ in the formula (I) include groups derived from saturated and unsaturated primary, secondary, and tertiary alcohols having 8 to 22 carbon atoms. Among them, groups derived from saturated primary alcohols, which are naturally occurring higher alcohols, such as octyl alcohol, decyl alcohol, and lauryl alcohol, and saturated primary alcohols and saturated secondary alcohols synthesized by the Ziegler process, the oxo process or the like are preferred from the viewpoint of scouring property and biodegradability, with saturated primary and secondary alcohols having 10 to 15 carbon atoms being still preferred.

In the polyoxyalkylene moiety constituting the component (A), 1 to 12 mol of EO in terms of an average mole number of added units, 1 to 4 mol of PO in terms of an average mole number of added units, and 1 to 12 mol of EO in terms of an average mole number of added units are added in a block form in this order as viewed from the $R_1$ side. Preferably, the average mole number of added EO units per block ranges from 3 to 8, and the average mole number of added P0 units ranges from 1 to 2. Further, the total average mole number (1+n) of added EO units in one molecule ranges preferably from 6 to 16, particularly preferably from 8 to 14. When the average mole number of added EO units per block is less than 1, the scouring property is deteriorated. On the other hand, when the average mole number of added EO units per block is larger than 12, the pour point becomes high, deteriorating the stability of the product at a low temperature. When the average mole number of added PO units is larger than 4, the scouring property is lowered. Further, in this case, the biodegradability is also lowered. On the other hand, when the average mole number of added PO units is less than 1, the pour point is excessively high, deteriorating the stability of the product at a low temperature. The construction of the block structure comprising $(EO)_1$, $(PO)_m$, and $(EO)_n$ as viewed from the $R_1$ side is indispensable from the viewpoint of excellent low-temperature stability and scouring property and increased active component concentration of the product.

The component (B) in the present invention is at least one compound selected from the group consisting of an anionic surfactant and a glycol ether.

The anionic surfactant as the component (B) contributes to an improvement in scouring property under highly alkaline conditions, and examples of the anionic surfactants usable herein include saturated and unsaturated fatty acids, saturated and unsaturated alcohol sulfate esters, polyoxyalkylene alkylsulfates, polyoxyalkylene alkylmono- and di-phosphates, and/or salts thereof. Among them, phosphate ester derivatives and sulfate ester derivatives of polyoxyalkylene alkyl ethers represented by the following formula (II), specifically polyoxyalkylene alkyl-sulfates and polyoxyalkylene alkylmono- and di-phosphates and/or salts of inorganic bases, such as bases comprising alkali metals and alkaline earth metals, and organic bases of the above compounds, are preferred. Still preferred are polyoxyalkylene alkylsulfates, and particularly preferred are salts which have been partially or wholly neutralized with a base such as an alkali metal hydroxide and an organic base.

$$R_2—O—(AO)_p—H \quad (II)$$

wherein $R_2$ is an alkyl, alkenyl, alkylaryl, or aralkyl group having 6 to 24 carbon atoms, AO is an oxyalkylene group having 2 to 3 carbon atoms, p is an average mole number of added oxyalkylene groups, ranging from 2 to 5.

Further, the anionic surfactant is preferably such that, in the formula (II), $R_2$ has 8 to 12 carbon atoms and AO is an oxyethylene group and the surfactant has been neutralized with a hydroxide of an alkali metal or an organic base. The term organic bases used herein refers to an organic or inorganic compound having in its molecule a nitrogen atom that is alkaline. Organic bases usable herein include amines having a total number of carbon atoms of 0 to 16, for example, ammonia, ethanolamine, straight-chain or cyclic alkylamines such as cyclohexylamine and cyclic amines such as morpholine, pyrrolidine, piperidine and pyridine, and aromatic amines such as aniline. Preferred nitrogen-containing amines include mono-, di-, and tri-alkylamines having a total number of carbon atoms of 2 to 10 optionally substituted with a hydroxyl group, particularly hydroxyl-substituted mono-, di-, and tri-hydroxyalkylamines.

The glycol ether as the component (B) is advantageous from the viewpoint of improving the scouring property and, in addition, reducing the viscosity in the case where the active component concentration of the composition has been increased. Preferred are glycol ethers having 3 to 10 carbon atoms, and particularly preferred are glycol monoethers, and, in addition, ethylene glycol monomethyl ether, ethylene glycol monopropyl ether, ethylene glycol monobutyl ether, diethylene glycol monomethyl ether, diethylene glycol monopropyl ether, and diethylene glycol monobutyl ether.

In the present invention, combined use of an anionic surfactant and a glycol ether as the component (B) is still preferred. In this case, the weight ratio of the anionic surfactant to the glycol ether ranges preferably from (9:1) to (1:9), particularly preferably from (7:3) to (2:8). In particular, use of the phosphate ester or sulfate ester derivatives of the polyoxyalkylene alkyl ether represented by the formula (II) in combination with the glycol ether is preferred.

The weight ratio of the nonionic surfactant as the component (A) to the anionic surfactant and/or glycol ether as the component (B), that is, (A):(B), ranges preferably from (40:60) to (99:1), more preferably from (50:50) to (95:5).

In the present invention, the scouring agent composition comprises, in terms of % by weight of active component, 40 to 90% by weight, preferably 50 to 80% by weight, of the component (A), 0 to 50% by weight, preferably 5 to 50 parts by weight, particularly preferably 10 to 40% by weight, of the component (B).

The total amount of the components (A) and (B) ranges preferably from 50 to 97% by weight, particularly preferably from 70 to 97% by weight. The balance (3 to 50% by weight) consists of water or water and optional component (s).

The scouring agent composition of the present invention has a viscosity ranging from about 50 to 150 cP (centipoise) at room temperature even when it comprises the nonionic surfactant represented by the formula (I) alone. When the nonionic surfactant is used in combination with the anionic surfactant or the glycol ether, the viscosity of the scouring agent composition ranges from about 50 to 120 cP at room temperature. The viscosity at 3° C. is not more than 500 cP, preferably not more than 400 cP.

The conventional scouring agent is distributed as an aqueous solution with the concentration of the active components other than water ranging from about 15 to 65% by weight. By contrast, in the present invention, even in the case of a higher active component concentration, the viscosity of the scouring agent composition is low, permitting the compactness to be increased without sacrificing the operability. Further, the scouring agent composition of the present invention has satisfactory scouring effect even under highly alkaline conditions.

If necessary, chemicals, for example, other nonionic surfactants, such as polyoxyethylene alkyl ethers and polyoxyethylene alkylaryl ethers, chelate dispersants, such as ethylenediaminetetraacetic acid (EDTA), nitrilotriacetic acid (NTA), poly(meth)acrylic acid, and (meth)acrylic acid/maleic acid copolymer, alkali buildes, such as soda ash, and caustic soda, and antifoaming agents, such as polyoxyalkylene ether, silicone oil, mineral oil and other agents, may be incorporated into or used in combination with the scouring agent composition of the present invention.

The scouring agent composition of the present invention has an active component concentration of 0.1 to 10 g/liter, an alkali builder (optional component) content of 0.2 to 5 g/liter, and a chelating agent (optional component) of 0.05 to 5 g/liter according to stains and soils in cloths.

The scouring agent of the present invention can be applied to natural fibers, such as cotton, hemp, and wool, combined woven fabrics of polyether, nylon, rayon, triacetate and the like, and blended woven fabrics thereof. The scouring may be carried out by any of conventional batchwise and continuous treatment processes. The scouring temperature generally ranges from room temperature to 140° C., preferably from 50 to 130° C., although it depends upon the type of the fiber.

EXAMPLES

Examples 1 to 13 and Comparative Examples 1 to 6

Various scouring agent compositions specified in Tables 1 and 2 were prepared, and the scouring property (wicking height and percentage residual soil) and the foam-height were evaluated as follows. The results of evaluation is summarized in Table 3.

[Evaluation of scouring property: part 1]

(1) Wicking Height

A cotton grey good was scoured under such conditions as shown in the following evaluation for percentage residual soil of fats and others. A sample cloth having a width of 2 cm and a length of 30 cm was cutoff from the treated cloth. The sample cloth was vertically suspended on a vat filled with an aqueous solution of a dye so as not to slack in such a manner that one end of the sample cloth is immersed in the aqueous solution. 15 min after the initiation of the suspension, the dye solution wicking height (mm) was measured. The larger the wicking height, the better the wetting property and the scouring property.

(2) Percentage Residual Soil (2-1) <Percentage residual soil in cotton>

A cotton grey good (residual soil: 1.05%) was scoured under the following conditions, and the percentage residual soil after the scouring was measured by extraction with diethyl ether using a Soxhlet's extractor.

Scouring conditions:

| scouring agent composition | |
|---|---|
| (active component) | 0.5 g/liter |
| caustic soda | 2.0 g/liter |
| scouring time | 30 min |
| scouring temp. | 110° C. |
| bath ratio | 1:15 |
| treatment water | 3° DH. |

(2-2) <Percentage residual soil in polyester>

A polyester grey good (residual soil: 2.34%) was scoured under the following conditions, and the percentage residual soil was measured in the same manner as described above.

Scouring conditions:

| scouring agent composition | |
|---|---|
| (active component) | 0.5 g/liter |
| caustic soda | 1.0 g/liter |
| scouring time | 30 min |
| scouring temp. | 120° C. |
| bath ratio | 1:15 |
| treatment water | 3° DH. |

[Evaluation on foam-height]

The foam-height was evaluated by the following method.

200 ml of a test solution (scouring agent: 0.3 g/liter in terms of active component; caustic soda: 1 g/liter) was placed in a 1-liter graduated cylinder, and aerate by blowing air at a flow rate of 1.5 liters/min into the solution through the bottom of the graduated cylinder by means of an air pump equipped with a ball filter, and the foam-height (mm) was measured in both 30 sec and 2 min after the initiation of the aeration.

TABLE 1

| | Formulation of compounds (% by weight) | Example 1 | 2 | 3 | 4 | 5 | 6 | 7 | 8 | 9 | 10 | 11 | 12 | 13 |
|---|---|---|---|---|---|---|---|---|---|---|---|---|---|---|
| Comp (A) | Dobanol 25*1 $(EO)_6(PO)_2(EO)_6$ | 65 | 26 | 65 | 65 | | | | | | | 40 | | 65 |
| | Kalcohl 8688*2 $(EO)_7(PO)_4(EO)_7$ | | | | | 65 | | | | | | | | |
| | Oxocol 1215*3 $(EO)_{10}(PO)_2(EO)_4$ | | | | | | 60 | | | | | | | |
| | Isodecyl alcohol $(EO)_6(PO)_2(EO)_6$ | | | | | | | 65 | 65 | 65 | 65 | | 65 | |
| Comp (B) | POE (3) isodecylsesquiphosphate · sodium salt | 5 | | | | | | | | | | | | |
| | POE (3) isodecylsesquiphosphate · triethanolamine salt | | 5 | | | | | | 5 | | | | | |
| | POE (3) 2-ethylhexylsulfate · triethanolamine salt | | | 5 | | 5 | 5 | 5 | | 15 | | 5 | 5 | |
| | Octylsulfate · triethanolamine salt | | | | 5 | | | | | | | | | |
| | Lauric acid · triethanol amine salt | | | | | | 5 | | | | | | | |

TABLE 1-continued

| Formulation of compounds (% by weight) | Example 1 | 2 | 3 | 4 | 5 | 6 | 7 | 8 | 9 | 10 | 11 | 12 | 13 |
|---|---|---|---|---|---|---|---|---|---|---|---|---|---|
| Ethyleneglycol mononethyl ether | 10 | 10 | 10 | 10 | 10 | | | | | | 10 | | |
| Diethyleneglycol monomethyl ether | | | | | | 10 | 10 | 10 | | 15 | | | |
| Water | 20 | 20 | 20 | 20 | 20 | 20 | 20 | 20 | 20 | 20 | 45 | 30 | 35 |

*1: a product of Mitsubishi Chemical Corporation (12 to 15 carbon atoms)
*2: a product of Kao Corp. (16 to 18 carbon atoms)
*3: a product of Kyowa Hakko Kogyo Co., Ltd. (12 to 15 carbon atoms)

TABLE 2

| Formulation of compounds (% by weight) | | Comparative compound 1 | 2 | 3 | 4 | 5 | 6 |
|---|---|---|---|---|---|---|---|
| Nonionic surfactant | Dobanol 25 $(EO)_6(PO)_6(EO)_6$ | 65 | | | | | |
| | Dobanol 25 $(EO)_{10}(PO)_2(EO)_{14}$ | | 65 | | | | |
| | Dobanol 25 $(EO)_6(PO)_2$ | | | 65 | | | |
| | Oxocol 1213 $[(EO)_5/(PO)_2]$-$(EO)_5$ | | | | 65 | | |
| | Oxocol 1213 $(PO)_3(EO)_{10}(PO)_2$ | | | | | 65 | |
| | Nonyl phenol $(EO)_9$ | | | | | | 65 |
| Dissolvent | POE (3) isodecylsesqui-phosphate · triethanolamine salt | 5 | 5 | 5 | 5 | 5 | 5 |
| | Ethyleneglycol monomethyl ether | 10 | 10 | 10 | 10 | 10 | 10 |
| | Water | 20 | 20 | 20 | 20 | 20 | 20 |

*4: a product of Kyowa Hakko Kogyo Co., Ltd. (12 to 13 carbon atoms)

TABLE 3

| | Scouring property: Wicking height (mm) | Percentage residual soil *5 (%): Cotton | Polyester | foam-height (mm): after 30 sec | after 2 min |
|---|---|---|---|---|---|
| Ex. 1 | 110 | 0.19 (81.9) | 0.20 (91.5) | 36 | 62 |
| Ex. 2 | 115 | 0.18 (82.9) | 0.19 (91.9) | 35 | 58 |
| Ex. 3 | 122 | 0.12 (88.6) | 0.15 (93.6) | 33 | 56 |
| Ex. 4 | 105 | 0.17 (83.8) | 0.18 (92.3) | 37 | 63 |
| Ex. 5 | 120 | 0.15 (85.7) | 0.17 (92.7) | 34 | 57 |

TABLE 3-continued

| | Scouring property: Wicking height (mm) | Percentage residual soil *5 (%): Cotton | Polyester | foam-height (mm): after 30 sec | after 2 min |
|---|---|---|---|---|---|
| Ex. 6 | 118 | 0.15 (85.7) | 0.18 (92.3) | 30 | 51 |
| Ex. 7 | 120 | 0.16 (84.8) | 0.19 (91.9) | 34 | 62 |
| Ex. 8 | 98 | 0.19 (81.9) | 0.23 (99.2) | 35 | 61 |
| Ex. 9 | 95 | 0.19 (81.9) | 0.20 (91.5) | 34 | 59 |
| Ex. 10 | 90 | 0.21 (80.0) | 0.21 (91.0) | 35 | 60 |
| Ex. 11 | 117 | 0.16 (84.8) | 0.18 (92.3) | 33 | 58 |
| Ex. 12 | 92 | 0.21 (80.0) | 0.23 (90.2) | 37 | 60 |
| Ex. 13 | 83 | 0.28 (73.3) | 0.28 (88.0) | 42 | 68 |
| Comp. 1 | 75 | 0.38 (63.8) | 0.42 (82.1) | 34 | 58 |
| Comp. 2 | 48 | 0.40 (61.9) | 0.47 (80.0) | 30 | 46 |
| Comp. 3 | 67 | 0.43 (59.0) | 0.50 (79.7) | 32 | 52 |
| Comp. 4 | 72 | 0.35 (66.7) | 0.49 (79.1) | 35 | 57 |
| Comp. 5 | 32 | 0.48 (54.3) | 0.58 (75.2) | 26 | 40 |
| Comp. 6 | 58 | 0.45 (57.1) | 0.45 (81.8) | 35 | 61 |

*5: numerical values within parentheses are the percentage removal of stain/soil determined based on the amount of the residual soil before and after the scouring.

[Evaluation of scouring property: part 2]

Cloths of polyether/cotton (50/50), wool, nylon, rayon, and triacetate fibers were scoured with the compositions specified in Table 4 under the conditions specified in Table 4. The percentage residual soil was measured in the same manner as described above. The results are summarized in Table 4.

TABLE 4

| Cloth material | | | polyether/cotton (50/50) | wool | nylon | rayon | triacetate |
|---|---|---|---|---|---|---|---|
| Scouring conditions | scouring agent composition (active component) | | 1.0 g/L | 1.0 g/L | 1.0 g/L | 1.0 g/L | 1.0 g/L |
| | NaOH | | 1.0 g/L | none | none | none | 0.5 g/L |
| | bath ratio | | 1:15 | 1:15 | 1:15 | 1:15 | 1:15 |
| | scouring temp. | | 85° C. | 60° C. | 90° C. | 90° C. | 80° C. |
| | scouring time | | 45 min | 20 min | 30 min | 1 min | 1 min |
| | hardness of treatment water | | 3° DH | 3° DH | 3° DH | 3° DH | 3° DH |
| Percentage residual soil before scouring (%) | | | 0.72 | 2.05 | 0.84 | 1.08 | 1.72 |
| Percentage residual soil after scouring (%) | Scouring composition | Ex. 2 | 0.12 | 0.38 | 0.15 | 0.35 | 0.43 |
| | | Ex. 3 | 0.10 | 0.34 | 0.11 | 0.30 | 0.39 |
| | | Ex. 7 | 0.14 | 0.35 | 0.16 | 0.32 | 0.40 |
| | | Ex. 9 | 0.09 | 0.32 | 0.15 | 0.33 | 0.42 |
| | | Ex. 10 | 0.17 | 0.42 | 0.20 | 0.41 | 0.53 |
| | | Ex. 13 | 0.16 | 0.45 | 0.21 | 0.39 | 0.59 |
| | | Comp. 1 | 0.29 | 0.84 | 0.36 | 0.53 | 0.81 |
| | | Comp. 3 | 0.31 | 0.89 | 0.36 | 0.58 | 0.87 |

[Evaluation of biodegradability]

For the compositions of Examples 3, 7, 8, and 9 and Comparative Examples 1, 4, 5, and 6, a biodegradation test was carried out by the BOD method in accordance with the degradation test specified in the Law Concerning the Examination and Regulation of Manufacture, etc. of Chemical Substances. In general, when the percentage biodegradation in this test is 60% or above, the biodegradability is regarded as good. In the present examples, the biodegradability was shown as "excellent" when the percentage biodegradation in this test was 80% or above; "good" when the percentage biodegradation in this test ranged from 60 to less than 80%; and "failure" when the percentage biodegradation in this test was less than 60%. The results are summarized in Table 5.

TABLE 5

[Low-temperature stability test]

| Composition | Biodegradability |
|---|---|
| Ex. 3 | excellent |
| Ex. 7 | excellent |
| Ex. 8 | excellent |
| Ex. 9 | excellent |
| Comp. 1 | failure |
| Comp. 4 | good |
| Comp. 5 | failure |
| Comp. 6 | failure |

For the compositions of Examples 1 to 4, 9 to 11, and 13 and Comparative Examples 2, 5, and 6, the viscosity was measured at 3° C. with a Brookfield viscometer. The low-temperature stability was evaluated as "X" when the viscosity was 500 cP or above; "○" when the viscosity ranged from 400 to less than 500 cP; and "◎" when the viscosity was less than 400 cP. The results are summarized in Table 6.

TABLE 6

| Composition | Low-temperature stability |
|---|---|
| Ex. 1 | ◎ |
| Ex. 2 | ◎ |
| Ex. 3 | ◎ |
| Ex. 4 | ◎ |
| Ex. 9 | ◎ |
| Ex. 10 | ◎ |
| Ex. 11 | ○ |
| Ex. 13 | ○ |
| Comp. 2 | x |
| Comp. 5 | ○ |
| Comp. 6 | x |

What is claimed is:

1. A method for scouring fiber, which comprises the steps of treating the fiber with a scouring agent comprising (A) a nonionic surfactant having the formula (I):

$$R_1—O—(EO)_l(PO)_m(EO)_nH \quad (I)$$

in which $R_1$ is an alkyl or an alkenyl, being straight or branched, having 8 to 22 carbon atoms, EO is an oxyethylene unit, PO is an oxypropylene unit, l and n are an average mole number of added oxyethylene units, m is an average mole number of added oxypropylene units, l is a number of 1 to 12, m is a number of 1 to 4 and n is a number of 1 to 12, provided that $(EO)_l$, $(PO)_m$ and $(EO)_n$ are blocks connected in this order, and scouring said fiber.

2. The method according to claim 1, in which the total amount of (A) in the scouring agent is 40 to 90 percent.

3. The method according to claim 1, in which the scouring agent is in a composition which further comprises (B) at least one compound selected from the group consisting of an anionic surfactant and a glycol ether.

4. The method according to claim 3, in which the anionic surfactant is a phosphate derivative or a sulfate derivative of a polyoxyalkylene alkyl ether having the formula (II):

$$R_2—O—(AO)_p—H \quad (II)$$

in which $R_2$ is an alkyl, an alkenyl, an alkylaryl or an aralkyl, having 6 to 24 carbon atoms, AO is an oxyalkylene unit having 2 to 4 carbon atoms, p is an average mole number of added oxyalkylene units, ranging from 2 to 5.

5. The method according to claim 3, in which the glycol ether has 3 to 10 carbon atoms.

6. The method according to claim 3, in which the weight ratio of (A) to (B) ranges from 40/60 to 99/1.

7. The method according to claim 3, in which (B) comprises both an anionic surfactant and a glycol ether at a weight ration ranging from 9/1 to 1/9.

8. The method according to claim 3, in which the anionic surfactant is selected from the group consisting of a polyoxyalkylene alkylsulfate, a polyoxyalkylene monophosphate, a polyoxyalkylene di-phosphate and a salt thereof with a basic inorganic compound or a basic organic compound.

9. The method of claim 3, in which the total amount of (A) and (B) in the scouring agent composition is 70 to 97 percent by weight.

10. The method of claim 3, in which (B) comprises a fatty acid or a salt of a fatty acid and an organic base.

* * * * *